6/7/83 XR 4,387,353 SR

United States Patent [19]
Giallorenzi et al.
[11] 4,387,353
[45] Jun. 7, 1983

[54] ACTIVE WAVEGUIDE COUPLER FOR SURFACE ACOUSTIC WAVES

[75] Inventors: Thomas G. Giallorenzi, Alexandria, Va.; Joseph F. Weller, Oxon Hill, Md.

[73] Assignee: The United States of America as represented by the Secretary of the Navy, Washington, D.C.

[21] Appl. No.: 832,507

[22] Filed: Sep. 12, 1977

[51] Int. Cl.[3] ..... H01P 5/04; H01P 5/18

[52] U.S. Cl. ..... 333/111; 333/113; 350/96.13

[58] Field of Search ..... 333/10, 30 R, 30 M, 333/109, 111, 113, 150, 152; 357/25, 27, 29; 310/313; 350/96.13

[56] References Cited

U.S. PATENT DOCUMENTS

| | | | |
|---|---|---|---|
| 3,406,358 | 10/1968 | Seidel et al. | 333/10 X |
| 3,560,891 | 2/1971 | MacLeay et al. | 333/10 X |
| 3,585,531 | 6/1971 | Degenford et al. | 333/10 X |
| 3,589,794 | 6/1971 | Marcatili | 333/10 X |
| 3,626,334 | 12/1971 | Keyes | 333/30 R |
| 3,753,157 | 8/1973 | Ash et al. | 333/30 R X |
| 3,893,047 | 7/1975 | Lardat | 333/30 R |
| 3,976,358 | 8/1976 | Thompson | 350/96.13 |
| 4,012,113 | 3/1977 | Kogelnik et al. | 350/96.13 |
| 4,078,186 | 3/1978 | Folen et al. | 333/30 M X |

*Primary Examiner*—Paul L. Gensler
*Attorney, Agent, or Firm*—Robert F. Beers; William T. Ellis; Philip Schneider

[57] ABSTRACT

Coupling devices for SAW's, which permit switching of SAW power between channels. Channel waveguides are laid down on or in the surface of a substrate. The waveguides have a coupling region in which they are close to each other. The input waveguide is formed from a material whose acoustic wave velocity characteristic can be changed by an external means. Various means for altering the velocity of the SAW, such as electric or optical fields, are employed by applying them to the coupling region of the input waveguide.

3 Claims, 5 Drawing Figures

ACTIVE WAVEGUIDE COUPLER FOR SURFACE ACOUSTIC WAVES

BACKGROUND OF THE INVENTION

This invention relates to acoustic wave couplers and especially to SAW couplers in which the amount of acoustic wave power switched between waveguides is controllable.

In the field of surface acoustic waves (SAW's), the use of waveguides within which to propagate the SAW's has been found advantageous since the practice permits higher power densities and the miniaturization of signal processing devices. Inevitably, employment of waveguides leads to situations where coupling between waveguides becomes necessary.

The prior art has used passive coupling between waveguides, varying the amount of switched power by the geometry of the guides at the coupling conjunctions and by the characteristics of the guide and substrate materials. Once these are chosen, however, the amount of coupling is fixed for a particular coupler. It is obvious, of course, that it would be desirable to have available a coupler in which the amount of power switched between one guide and another could be controlled.

SUMMARY OF THE INVENTION

The present invention comprises a pair of channel waveguides located on or at the surface of a substrate and capable of carrying SAW's. SAW power is switched between waveguides by utilizing variable means which can change the wave velocity in the waveguide carrying the SAW.

DETAILED DESCRIPTION OF THE INVENTION

Figure 1:
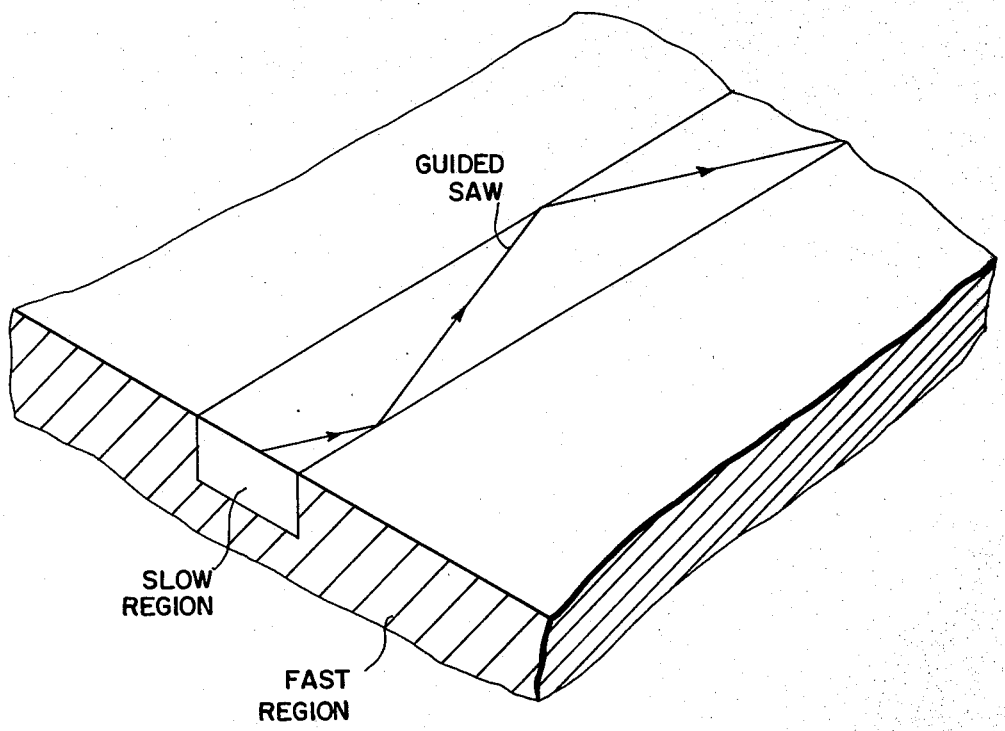
FIG. 1 is a schematic illustration of an infused channel waveguide for a SAW.

Channel waveguides for SAW's can be made by depositing a thin film on the surface of a substrate or infusing material in a thin channel at the surface of a substrate. (These will be designated hereinafter as waveguides "lying on or at" the surface of the substrate. The infused channel waveguide is schematically illustrated in FIG. 1. To confine the SAW to the waveguide, it is necessary to surround the guiding material with a material in which the wave propagates with a faster velocity.

One of the simplest guidance structure is a thin-film strip overlay that slows down the wave in the guide region. A thin-film metallic overlay can be used to slow the wave in piezoelectric crystals because it changes the boundary conditions by causing the free surface to have a short-circuited condition. Dielectric overlays can also be used; the SAW velocity can be slowed down because of mass loading.

SAW power can also be transferred between adjacent guides which are close to each other. The normal modes for wave propagating in two interacting guides consist of symmetric and antisymmetric modes. If only one guide is initially excited, both symmetric and antisymmetric modes will be generated. The amplitude of these modes will propagate unchanged unless one guide is lossier than the other. Assuming this not to be the case, then the only effect of modal propagation will be a phase shift between the two modes after they have propagated any distance. This phase shift is a result of the fact that both modes propagate at different velocities. The superposition of the symmetric and antisymmetric modal amplitudes results in a field distribution in the two guides which changes with distance. As the phase shift varies with distance, energy is thus transferred back and forth between the two guides. The coupling length over which the complete power transfer between one guide and the other is accomplished is given by:

$$l_c=\pi/(k_s-k_a) \quad (1)$$

where $k_s$ and $k_a$ are symmetric and antisymmetric wavevectors respectively. The amount of power transferred to the other guide is thus a function of $k_s$ and $k_a$, which in turn are functions of the wave velocities for each mode, the channel widths and the separation between the channels. To control power flow, and thus affect switching, it is desirable to vary these parameters.

Figure 2:
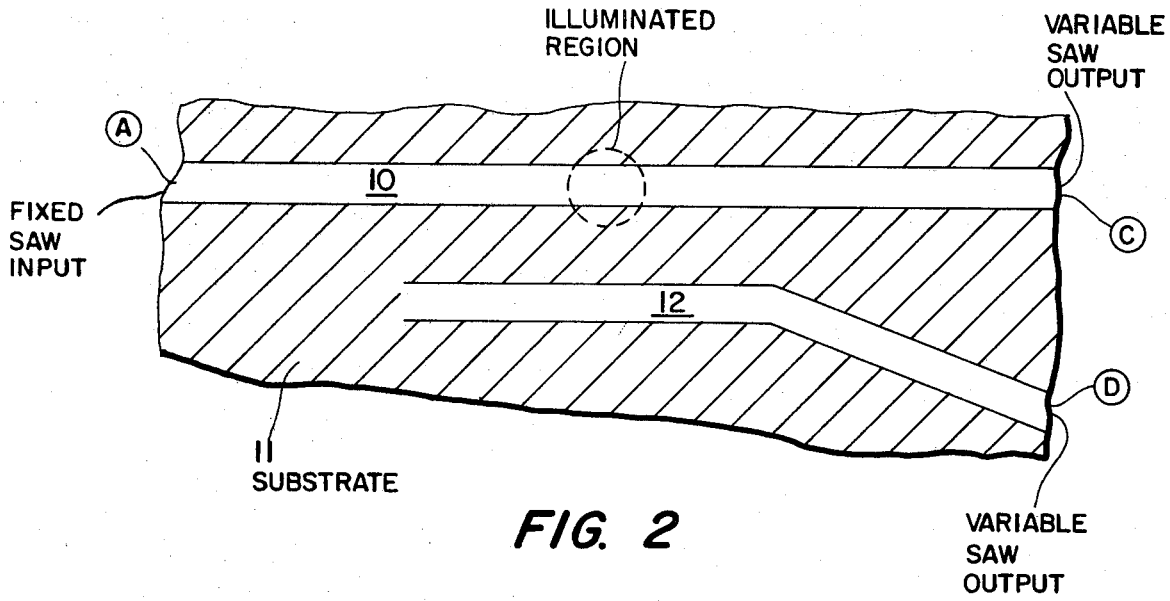
FIG. 2 is a schematic drawing showing an embodiment of the invention in which the switching is optically controlled.

The present invention provides means for actively changing coupling between two acoustic waveguides by the application of external fields to at least one of the waveguides. The external fields can be optical, electrical or magnetic. FIG. 2 shows how an optical field can be used to switch acoustical power between waveguides. A pair of channel waveguides 10 and 12 are placed on or at the surface of a substrate 11. The waveguides have regions which are parallel and close to each other so that coupling of power may occur. A SAW is fed into an input waveguide 10 at input A. The waveguide channels are made of a photoconductive material, such as CdS, CdSe, Si, GaAs, etc., and the substrate 11 may be glass, for example. Another configuration would be a photoconductive overlay on indiffused channels fabricated on the glass substrate. In the dark, the guide acts as a typical mass-loaded waveguide coupler. However, if the input waveguide in which the SAW is propagating is illuminated in the region where the guides interact (hereinafter called the coupling region), the illuminated portion acts as if a thin film of metal were shorting the surface of the substrate. This changes the boundary conditions of the substrate, the effect being to alter the wavevectors of the symmetric and antisymmetric modes of the coupled waveguides, resulting in a switching of the wave to waveguide 12 which will be called the coupled waveguide. Output SAW's can be obtained at output ports C of the input waveguide 10 and D of the coupled waveguide 12. The strengths of the waves derivable at output ports C and D depend on the intensity and the area of the illumination.

Figure 3:
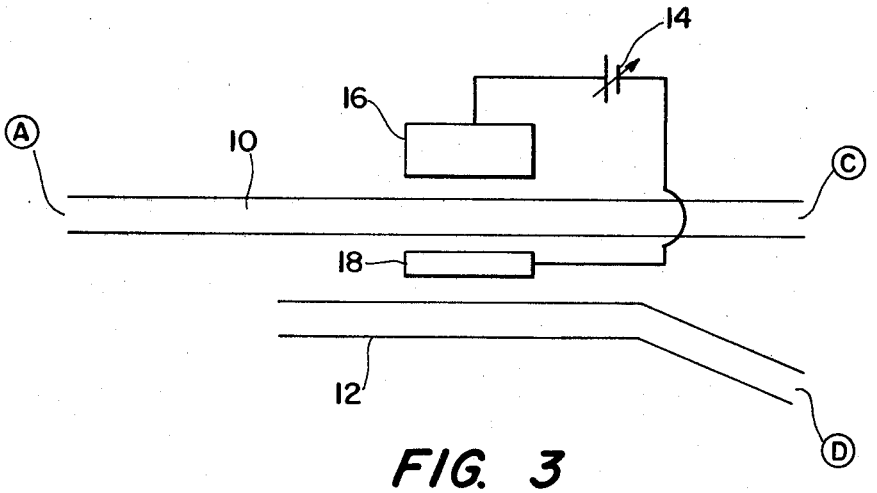
FIG. 3 is a schematic drawing showing an embodiment of the invention in which the switching is electrically controlled.

To use an electric field, thin-film metallic electrodes 16 and 18 are deposited on either side of input waveguide 10 and a variable source of electric potential 14 is connected across the electrodes as shown in FIG. 3. If the waveguides are indiffused in the surface of the substrate, the waveguide material may be a metal such as Ti or Ni and the substrate may be $LiNbO_3$ for example. It is known that, for piezoelectric materials, an electric field causes a change in density due to the induced polarization. This changes the wave velocity, since the wave equation used to describe particle displacements in an elastic medium involves the density of the material. The electric field, since it alters the velocity in the uncoupled waveguide, also changes the wavevectors for the two coupled waveguides. The field can be changed to give variable outputs at ports C and D depending on the voltage, electrode structure, and material parameters of the waveguide and substrate materials.

Electrical fields can also be used to change surface wave velocity if a semiconductor thin film or bulk piece of semiconductor evanescently coupled to a piezoelectric half space are used. In this case, the velocity of the acoustic wave is affected by the relative drift velocity of carriers in the semiconductor. By applying an electric field, the carriers may move faster or slower than the acoustic wave. This affects the boundary conditions seen by the acoustic waves and changes the wave velocity. When this effect is applied to only one of the coupled channels, electrically controlled switching can be effected. Additionally, an optical field can be used in conjunction with the electric field. The purpose of the optical field is to generate carriers which in turn affect the acoustic wave propagation properties.

Figure 4:
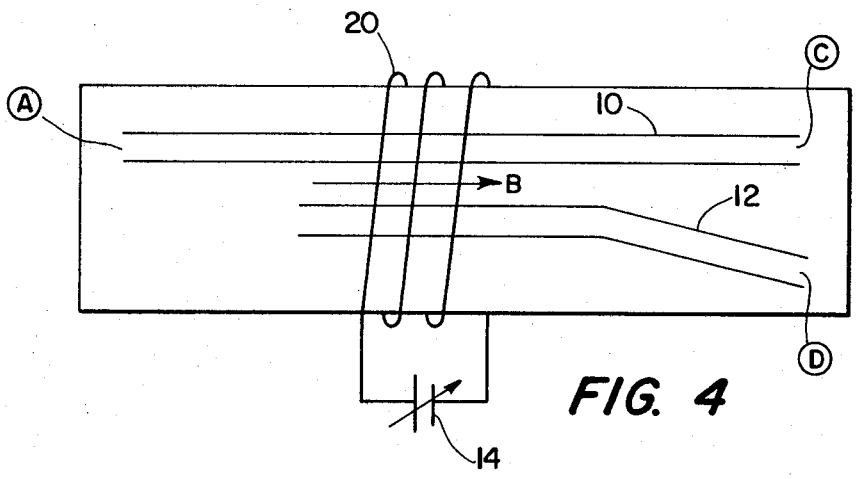
FIG. 4 is a schematic drawing showing an embodiment of the invention in which the switching is magnetically controlled.

A magnetic field can also be used to switch acoustic power between channel waveguides. As shown in FIG. 4 schematically, a magnetic field whose strength can be varied as desired (hereinafter designated variable—strength magnetic field) is produced in the coupling region of waveguide 10 by a coil and variable source of current or voltage 14. (Any known method of producing a variable—strength magnetic field B in the direction of the channel waveguide A may be employed). Input waveguide 10 in this case is made of a magnetic-elastic material, such as Ni or Co, and the substrate 10 may be made of glass, for example. The coupled waveguide 12 is made of any non-magnetic-elastic material which will support propagation of a SAW. If the magnetic field B can be applied only to the input waveguide 10, the coupled waveguide 12 can, of course, be made of any material which will support SAW propagation. The magnetic field alters the elastic constants of the material of the waveguide 10, and since the elastic constants are also used in the wave equation for the particle displacement in an elastic material, a magnetic field changes the wave velocity and consequently the wavevectors of the guide.

Figure 5:
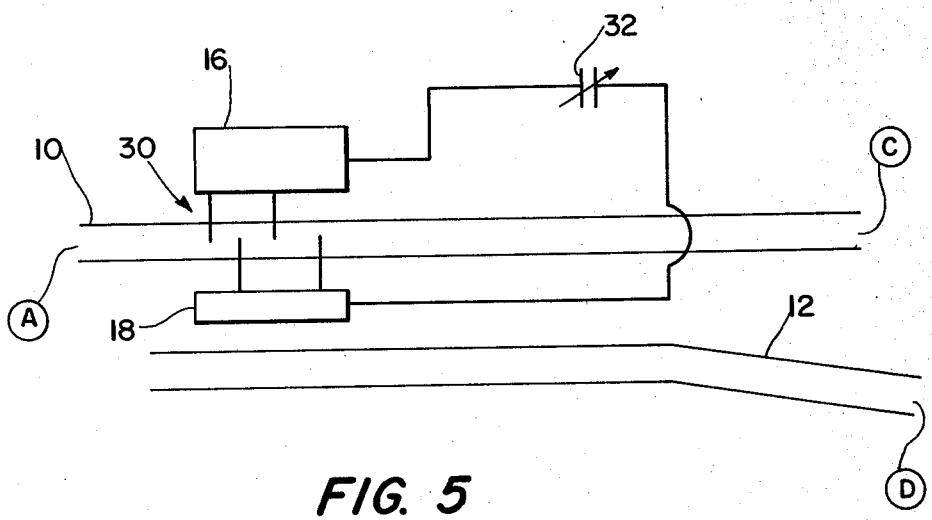
FIG. 5 is a schematic drawing showing an embodiment of the invention in which the switching is electronically controlled.

The SAW velocity can also be varied electronically as shown in FIG. 5. Here an interdigital transducer (IDT) 30 is placed in contact with the input waveguide 10 and a variable resistive or capacitive load 32, preferably the latter, is connected between the electrodes 16 and 18 (i.e., across the IDT). Variation of the load acts to vary the velocity of the SAW, the fingers of the IDT acting as strips shorting the tangential surface field of the SAW.

In the electronic version, the waveguides may be a non-conductive material such as CdS or GaAs, for example, laid down on a substrate material such as $LiNbO_3$. The IDT should be made of metal, such as Al, laid down on the substrate beneath the waveguide.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A device for controllably coupling SAW power between channel waveguides comprising, in combination:

a substrate formed with a surface;

an input channel waveguide and a coupled waveguide, both located on or at the surface of said substrate and capable of having SAW's propagated therethrough, said waveguides having a coupled region and output ports, and said input waveguide also having an input port; and variable means acting upon said input waveguide in the coupled region to alter the velocity of any SAW propagating in that region, the action of said variable means being controllable so that the velocity of said SAW is controllable, said variable means comprising an interdigital transducer and a variable capacitive load connected thereto.

2. A device for controllably coupling SAW power between channel waveguides comprising, in combination:

a substrate formed with a surface;

an input channel waveguide and a coupled waveguide, both located on or at the surface of said substrate and capable of having SAW's propagated therethrough, said waveguides having a coupled region and output ports, and said input waveguide also having an input port; and variable means acting upon said input waveguide in the coupled region to alter the velocity of any SAW propagating in that region, the action of said variable means being controllable so that the velocity of said SAW is controllable, said variable means comprising an interdigital transducer and a variable resistive load connected thereto.

3. A device for controllably coupling SAW power between channel waveguides comprising, in combination:

a substrate formed with a surface;

an input channel waveguide and a coupled waveguide, both located on or at the surface of said substrate and capable of having SAW's propagated therethrough, said waveguides having a coupled region and output ports, and said input waveguide also having an input port; and variable means acting upon said input waveguide in the coupled region to alter the velocity of any SAW propagating in that region, the action of said variable means being controllable so that the velocity of said SAW is controllable, said variable means comprising a source of light variable intensity and said input waveguide being formed from a photoconductive material.

* * * * *